US007317455B2

(12) United States Patent
Wright

(10) Patent No.: US 7,317,455 B2
(45) Date of Patent: Jan. 8, 2008

(54) BIAS VOLTAGE OFFSET CIRCUIT

(75) Inventor: Charles A. Wright, Fowlerville, MI (US)

(73) Assignee: Xerox Corporation, Norwalk, CT (US)

( * ) Notice: Subject to any disclaimer, the term of this patent is extended or adjusted under 35 U.S.C. 154(b) by 691 days.

(21) Appl. No.: 10/939,182

(22) Filed: Sep. 10, 2004

(65) Prior Publication Data

US 2005/0110744 A1 May 26, 2005

Related U.S. Application Data

(60) Provisional application No. 60/501,803, filed on Sep. 10, 2003.

(51) Int. Cl.
*G03G 15/00* (2006.01)

(52) U.S. Cl. ..... 345/211; 345/210; 345/212; 323/265; 365/189.09

(58) Field of Classification Search ..... 345/210, 345/211, 212; 323/265; 365/189.09
See application file for complete search history.

(56) References Cited

U.S. PATENT DOCUMENTS 4,126,854 A 11/1978 Sheridon
4,143,103 A 3/1979 Sheridon
5,111,196 A 5/1992 Hunt
5,179,652 A 1/1993 Rozmanith et al.
5,185,857 A 2/1993 Rozmanith et al.
5,250,789 A 10/1993 Johnsen
5,389,945 A 2/1995 Sheridon
5,473,146 A 12/1995 Goodwin, III
5,500,721 A * 3/1996 Randall et al. ..... 399/37
5,604,027 A 2/1997 Sheridon
5,723,204 A 3/1998 Stefik
5,751,257 A 5/1998 Sutherland
5,936,259 A 8/1999 Katz et al.
5,981,970 A 11/1999 Dimitrakopoulos et al.
6,047,263 A 4/2000 Goodwin, III
6,161,122 A 12/2000 Hawkes
6,194,837 B1 2/2001 Ozawa
6,253,190 B1 6/2001 Sutherland
6,265,243 B1 7/2001 Katz et al.
6,311,308 B1 10/2001 Adamec
6,317,724 B1 11/2001 Goodwin, III et al.
6,343,273 B1 1/2002 Nahan et al.
6,373,453 B1 4/2002 Yudasaka
6,442,531 B1 8/2002 Goodwin, III
6,469,617 B1 10/2002 Goodwin, III et al.

(Continued)

*Primary Examiner*—Bipin Shalwala
*Assistant Examiner*—Vincent E. Kovaick
(74) *Attorney, Agent, or Firm*—Pillsbury Winthrop Shaw Pittman, LLP

(57) ABSTRACT

A bias offset voltage circuit for controlling one or more devices is disclosed. The bias offset voltage circuit includes a three voltage sources connected in series and a switching element. Each voltage source includes a positive terminal and a negative terminal. The switching element includes a positive input terminal, a negative input terminal, and an output terminal. The negative terminal of the first voltage source is connected to the negative input terminal. The positive terminal of the third voltage source is connected to the positive input terminal. The terminals of the second voltage source are used to drive a first device. The output terminal of the switching element drives a second device. The bias offset voltage circuit may be used to provide proper voltages to each of the devices where the higher-supplied voltage could damage the device supplied with the lower supplied voltage, or vice versa.

10 Claims, 2 Drawing Sheets

U.S. PATENT DOCUMENTS 6,496,805 B1 12/2002 Goodwin, III et al.
6,502,219 B2 12/2002 Adamec
6,518,949 B2 2/2003 Drzaic
6,551,717 B2 4/2003 Katz et al.
6,581,828 B1 6/2003 Forsythe et al.
2001/0022597 A1* 9/2001 Yoshida ..... 347/14
2003/0016566 A1* 1/2003 Yamaki et al. ..... 365/189.09

* cited by examiner

BIAS VOLTAGE OFFSET CIRCUIT

CROSS-REFERENCE TO RELATED APPLICATION

This application claims benefit under 35 U.S.C. § 119(e) of U.S. provisional application Ser. No. 60/501,803, filed on Sep. 10, 2003.

FIELD OF INVENTION

The present invention relates generally to electronic circuits for providing a voltage source to a system, and, more particularly, to electronic circuits for providing two or more voltage sources in electronically programmable and/or controllable signs.

BACKGROUND OF THE INVENTION

Traditional signs have been based upon printed materials, paper, plastic, metal, etc., and are therefore not programmable. Accordingly, they are not easily changed. In an attempt to overcome this problem, electronically programmable and/or controllable signs have been in existence for many years. For example, liquid crystal diode (LCD) displays, cathode ray tube (CRT) displays, and other electrically-addressable displays will display an image in response to applied electric signals or fields. However, such signs typically require a large amount of electricity, since they must provide illumination in order to be visible to a viewer.

Electrical twisting-cylinder and rotary ball displays, such as those described in U.S. Pat. Nos. 4,126,854 and 4,143,103, incorporated herein by reference in their entirety, have been developed to overcome the problems with previous programmable signs. Twisting-cylinder displays, rotary-ball displays and related displays have numerous advantages over conventional displays, such as LCDs and CRTs, since they are suitable for viewing in ambient light, they retain an image indefinitely in the absence of an applied electric field, and they can be made to be very lightweight and/or flexible. For further advantages of such displays, see U.S. Pat. No. 5,389,945, incorporated herein by reference in its entirety. Such displays are referred to herein as "electric paper" displays. An example of such a display is a SmartPaper™ display, from Gyricon Media, Inc.

One method of applying an electric field to electric paper display elements is by using a thin film transistor (TFT) active matrix array. A TFT active matrix array is composed of an array of TFTs. A TFT is a Metal-Oxide-Semiconductor Field Effect Transistor (MOSFET) implemented using thin film technology. A TFT uses thin films, made of either amorphous silicon (a-Si) or polycrystalline silicon (p-Si), and a glass substrate. Current flows between the source and drain of a TFT when a voltage is applied to its gate. Thus, by connecting the gate of a TFT to the power rail of the TFT active matrix array, a TFT is turned on (at a positive voltage). If the gate of a TFT is connected to the ground rail, the TFT is turned off (at zero voltage).

It is advantageous to use TFT active matrix arrays with electric paper displays because a localized electric field used to rotate one or more rotatable elements within an electric paper display may be generated from each TFT. TFT active matrix arrays are used as active switches for each picture element or pixel. A TFT active matrix array is similar to a DRAM array. In other words, each display element is at the intersection of horizontal and vertical lines and may be addressed by enabling both lines. A TFT-based display may typically employ one transistor for each sub pixel of the display. Three sub-pixels—pertaining to red, green and blue electric paper display elements—may be used to make one pixel in a color display. Alternatively, a single sub-pixel may be used to make one pixel in a monochromatic display. A sub-pixel may include multiple rotatable elements.

Numerous circuits for powering electronic devices exist. FIG. 1 illustrates an exemplary prior art circuit for electrically powering an electronic device. The circuit of FIG. 1 includes a voltage source 110 and a switching element 115. The voltage source 110 possesses a positive terminal 111 connected to a positive input terminal 116 of the switching element 115 and a negative terminal 112 connected to a negative input terminal 117 of the switching element 115. The positive terminal 111 of the voltage source 110 is also connected to a power rail of a first device 120. The negative terminal 112 of the voltage source 110 is also connected to a ground rail of the first device 120. The first device 120 of FIG. 1 is a thin-film transistor (TFT) active matrix array. The TFT active matrix array 120 includes a plurality of TFTs.

The switching element 115 selects between its positive input terminal 116 and its negative input terminal 117 to determine the voltage on its output terminal 118. The output terminal 118 of the switching element 115 is connected to a second device 125: The second device 125 shown in FIG. 1 is an electric paper display. An electric paper display 125 includes an array of rotatable elements, such as bichromal balls, and a conductive layer 126. One or more rotatable elements correspond to each TFT in the TFT active matrix array 120. Likewise, one or more TFTs can correspond to each rotatable element.

The output terminal 118 of the switching element 115 is connected to a conductive layer 126 of an electric paper display 125. If the positive input terminal 116 is selected, then the conductive layer 126 is driven to a positive voltage. If the negative input terminal 117 is selected, then the conductive layer 126 is driven to zero volts. For each rotatable element, if a voltage differential between the conductive layer 126 and a TFT associated with the rotatable element is greater than or equal to a threshold voltage, the rotatable element rotates into an orientation displaying a first hemisphere to a viewer of the electric paper display 125. If the voltage differential is reversed, the rotatable element rotates into an orientation displaying a second hemisphere to a viewer. If the voltage differential between the TFT and the conductive layer 126 is less than a threshold voltage or zero, then the rotatable element maintains its present orientation. Thus, by altering the connection of the gates of each TFT in the TFT active matrix array 120 to the power or ground rails and by selecting the voltage level of the conductive layer 126 of the electric paper display 125, via the switching element 115, the rotatable elements are aligned to display known patterns.

One problem with the implementation of the prior art circuit occurs when the operating voltage for components of the first device 120 is less than the operating voltage for components in the second device 125. In this case, if the operating voltage of the second device 125 were used to power the first device 120 as well, the first device 120 could be damaged and experience a vastly decreased lifespan.

What is needed is an electronic circuit that overcomes this disadvantage of prior art circuits by providing proper voltage levels to all devices within a system.

SUMMARY OF THE INVENTION

The present invention relates to providing proper voltage levels to one or more devices within a system. In a preferred embodiment, the present invention relates to providing more than one voltage source to electric paper including rotatable elements, such as bichromal beads, selected by a thin film transistor active matrix array.

In a preferred embodiment of the present invention, a bias offset voltage circuit includes a first voltage source, a second voltage source, a third voltage source, and a switching element. The first voltage source includes a first positive terminal and a first negative terminal and has a first voltage differential equal to the voltage difference between the first positive terminal and the first negative terminal. The second voltage source includes a second positive terminal and a second negative terminal and has a second voltage differential equal to the voltage difference between the second positive terminal and the second negative terminal. The third voltage source includes a third positive terminal and a third negative terminal and has a third voltage differential equal to the voltage difference between the third positive terminal and the third negative terminal. The switching element includes a positive input terminal, a negative input terminal and an output terminal. The first negative terminal is electrically connected to the negative input terminal. The first positive terminal is electrically connected to the second negative terminal. The second positive terminal is electrically connected to the third negative terminal. The third positive terminal is electrically connected to the positive input terminal. In a further embodiment, the circuit includes a first device having a power plane electrically connected to the positive terminal of the second voltage source and a ground plane electrically connected to the negative terminal of the second voltage source and a second device having a power plane electrically connected to the output of the switching element.

In an embodiment, the first device is a thin film transistor active matrix array including a plurality of thin film transistors and the second device is a rotatable element display including a plurality of rotatable elements. Each of the plurality of thin film transistors may correspond to one of the plurality of rotatable elements. In an embodiment, the second voltage differential is less than an optimal voltage for rotating each of the plurality of rotatable elements in the rotatable-element display. In a further embodiment, the sum of the first voltage differential and the second voltage differential is greater than or equal to the optimal voltage for rotating each of the plurality of rotatable elements in the rotatable element display. In a further embodiment, the sum of the second voltage differential and the third voltage differential is greater than or equal to the optimal voltage for rotating each of the plurality of rotatable elements in the rotatable element display.

In an embodiment, the first voltage differential is approximately equal to the third voltage differential. In an embodiment, the first voltage differential is approximately equal to 20 volts, the second voltage differential is approximately equal to 60 volts and the third voltage differential is approximately equal to 20 volts.

In a preferred embodiment, a bias offset voltage circuit includes a first voltage source, one or more pairs of voltage sources, and one or more switching elements. The first voltage source has a first positive terminal and a first negative terminal. The one or more pairs of voltage sources each have a negative voltage source and a positive voltage source. Each negative voltage source includes a positive terminal and a negative terminal. Each positive voltage source includes a positive terminal and a negative terminal. The one or more switching elements each include a positive input terminal, a negative input terminal, and an output terminal. Each positive input terminal is electrically connected to a positive terminal of a positive voltage source of a pair of voltage sources. Each corresponding negative input terminal is electrically connected to the negative terminal of the corresponding negative voltage source of the pair of voltage sources. The first positive terminal is electrically connected to the negative terminal of the positive voltage source of a first pair of voltage sources. The first negative terminal is electrically connected to the positive terminal of the negative voltage source of a first pair of voltage sources. The negative terminal of the positive voltage source of each subsequent pair of voltage sources is electrically connected to the positive terminal of the positive voltage source of the preceding pair of voltage sources. The positive terminal of the negative voltage source of each subsequent pair of voltage sources is electrically connected to the negative terminal of the negative voltage source of the preceding pair of voltage sources.

BRIEF DESCRIPTION OF THE DRAWINGS

Aspects, features, benefits and advantages of the embodiments of the present invention will be apparent with regard to the following description, appended claims and accompanying drawings where:

DETAILED DESCRIPTION OF THE INVENTION

Before the present compositions and methods are described, it is to be understood that this invention is not limited to particular compositions, methodologies or protocols described, as these may vary. It is also to be understood that the terminology used in the description is for the purpose of describing the particular versions or embodiments only, and is not intended to limit the scope of the present invention which will be limited only by the appended claims.

It must also be noted that as used herein and in the appended claims, the singular forms "a," "an" and "the" include plural references unless the context clearly dictates otherwise. Thus, for example, reference to a "voltage source" is a reference to one or more voltage sources and equivalents thereof known to those skilled in the art, and so forth. Unless defined otherwise, all technical and scientific terms used herein have the same meanings as commonly understood by one of ordinary skill in the art. Although any methods, devices and material similar or equivalent to those described herein can be used in the practice of testing of embodiments of the present invention, the preferred methods, devices, and materials are now described. All publications mentioned herein are incorporated by reference. Nothing herein is to be construed as an admission that the invention is not entitled to antedate such disclosure by virtue of prior invention.

Figure 1:
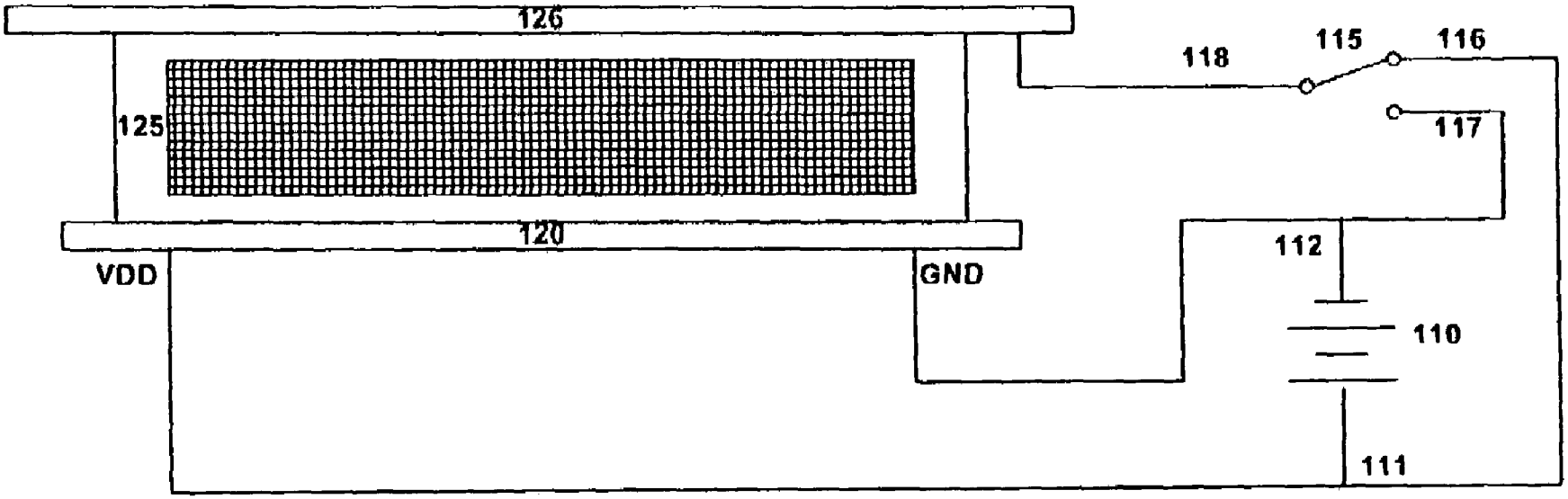
FIG. 1 illustrates a prior art circuit for electrically powering an electronic circuit.
Figure 2:
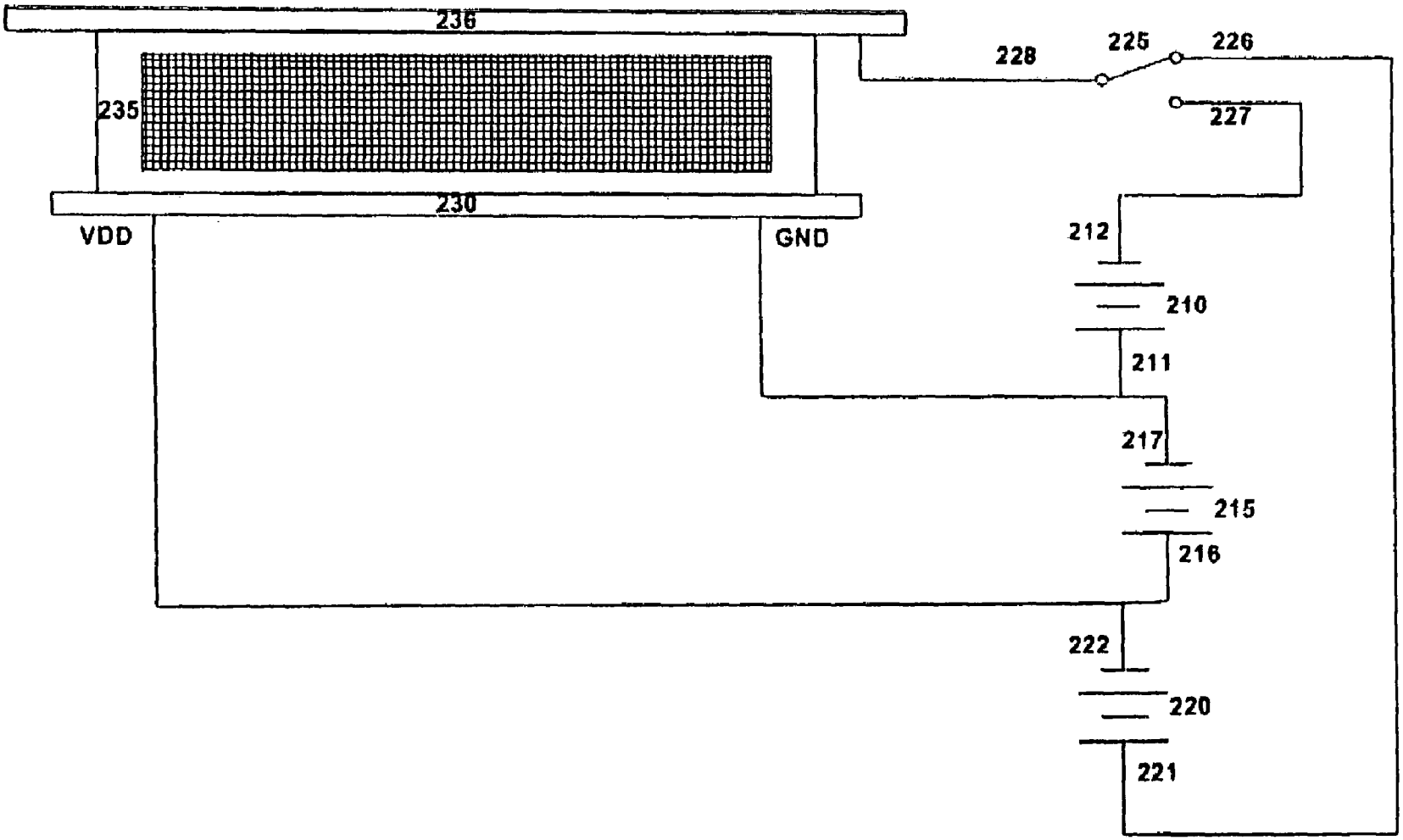
FIG. 2 illustrates an exemplary circuit for electrically powering an electronic circuit according to an embodiment of the present invention.

FIG. 2 illustrates an exemplary circuit for electrically powering an electronic circuit according to an embodiment of the present invention. The bias offset voltage circuit 200 of the present invention may include a first voltage source 210, a second voltage source 215, a third voltage source 220, and a switching element 225. The first voltage source 210 may include a first positive terminal 211 and a first negative terminal 212. The second voltage source 215 may include a second positive terminal 216 and a second negative terminal 217. The third voltage source 220 may include a third positive terminal 221 and a third negative terminal 222. The switching element 225 may include a positive input terminal 226, a negative input terminal 227 and an output terminal 228.

The first positive terminal 211 may be electrically connected to the second negative terminal 217. The second positive terminal 216 may be electrically connected to the third negative terminal 222. The first negative terminal 212 may be electrically connected to the negative input terminal 227. The third positive terminal 221 may be electrically connected to the positive input terminal 226. The output terminal 228 may be selectably connected to either the positive input terminal 226 or the negative input terminal 227 at any given time.

The bias voltage offset circuit 200 of the present invention may be used to drive a first device 230 and a second device 235. The second positive terminal 216 may be electrically connected to the power rail of the first device 230, and the second negative terminal 217 may be electrically connected to the ground rail of the first device 230. In a preferred embodiment, the first device 230 may be a TFT active matrix array including an array of TFTs. At any given time, each TFT may be connected to either the power rail or the ground rail of the TFT active matrix array 230. The connection of each gate may be altered to connect to the other of the power rail and the ground rail at a future time.

In the preferred embodiment, the second device 235 may be an electric paper display. The electric paper display 235 may include an array of rotatable elements, such as bichromal balls, and a conductive layer 236. Each TFT in the TFT active matrix array 230 may correspond to one or more rotatable elements. Likewise, each rotatable element may correspond to one or more TFTs. The conductive layer 236 may be electrically connected to the output terminal 228 of the switching element 225. For each rotatable element, if a voltage differential between the conductive layer 236 and a TFT associated with the rotatable element is greater than a threshold voltage, the rotatable element may rotate into an orientation displaying a first hemisphere to a viewer of the electric paper display 235. If the voltage differential is reversed, the rotatable element may rotate into an orientation displaying a second hemisphere to a viewer. If the voltage differential between the TFT and the conductive layer 236 is less than a threshold voltage, then the rotatable element may maintain its present orientation. Thus, by altering the connection of the gates of each TFT in the TFT active matrix array 230 to the power or ground rails and by selecting the voltage level of the conductive layer 236 of the electric paper display 235, via the switching element 225, the rotatable elements may be aligned to display known patterns.

In a preferred embodiment, the voltages supplied by each of the voltage sources 210, 215 and 220 may be selected based on the operating voltage of the first device 230 and the second device 235. For example, where the first device 230 is a TFT active matrix array, the voltage supplied by the second voltage source 215 may be selected to be approximately a maximum value at which the TFT active matrix array 230 may operate. In the example, where the second device 235 is an electric paper display, the voltages supplied by each of the first voltage source 210 and the third voltage source 220 may be selected to be greater than or equal to the differential between an optimal voltage for rotation of a rotatable element in the electric paper display 235 and the voltage supplied by the second voltage source 215. Preferably, the voltages supplied by each of the first voltage source 210 and the third voltage source 220 may be less than the threshold voltage for rotation of a rotatable element in the electric paper display 235. In a preferred embodiment, the second voltage source 215 may supply a voltage of approximately 60 volts, and the first voltage source 210 and the third voltage source 220 may each supply a voltage of approximately 20 volts.

In the preferred embodiment, four voltage differential states may be achieved between the conductive layer 236 and a TFT. Two states may occur if the switching element 225 connects the positive input terminal 226 to its output terminal 228. In this case, the third positive terminal 221 may be connected to the conductive layer 236 of the electric paper display 235.

If a TFT in the TFT active matrix array 230 is connected to the power rail, then the TFT may be at a voltage equal to the voltage at the second positive terminal 216. In this case, the voltage differential between the TFT and the conductive layer 236 of the electric paper display 235 may equal the voltage differential between the third positive terminal 221 and the third negative terminal 222. In a preferred embodiment, one or more rotatable elements corresponding to the TFT may maintain their current orientation under these circumstances because the voltage differential across the one or more rotatable elements (i.e., the voltage supplied by the third voltage source 220) may preferably be less than the threshold voltage for rotation of the one or more rotatable elements.

If a TFT in the TFT active matrix array 230 is connected to the ground rail, then the TFT may be at a voltage equal to the voltage at the second negative terminal 217. In this case, the voltage differential between the TFT and the conductive layer 236 of the electric paper display 235 may equal the voltage differential between the third positive terminal 221 and the second negative terminal 217. In a preferred embodiment, one or more rotatable elements corresponding to the TFT may align to display a first hemisphere under these circumstances because the voltage differential across the one or more rotatable elements (i.e., the sum of the voltage supplied by the third voltage source 220 and the voltage supplied by the second voltage source 215) may preferably be greater than the threshold voltage for rotation of the one or more rotatable elements.

Two more states may occur if the switching element 225 connects the negative input terminal 227 to its output terminal 228. In this case, the first negative terminal 212 may be connected to the conductive layer 236 of the electric paper display 235.

If a TFT in the TFT active matrix array 230 is connected to the power rail, then the TFT may be at a voltage equal to the voltage at the second positive terminal 216. In this case, the voltage differential between the TFT and the conductive layer 236 of the electric paper display 235 may equal the voltage differential between the second positive terminal 216 and the first negative terminal 212. In a preferred embodiment, one or more rotatable elements corresponding to the TFT may align to display a second hemisphere under these circumstances because the voltage differential across the one or more rotatable elements (i.e., the sum of the voltage supplied by the first voltage source 210 and the voltage supplied by the second voltage source 215) may preferably be greater than the threshold voltage for rotation of the one or more rotatable elements.

If a TFT in the TFT active matrix array 230 is connected to the ground rail, then the TFT may be at a voltage equal to the voltage at the second negative terminal 217. In this case, the voltage differential between the TFT and the conductive layer 236 of the electric paper display 235 may equal the voltage differential between the first positive terminal 211 and the first negative terminal 212. In a preferred embodiment, one or more rotatable elements corresponding to the TFT may maintain its current orientation under these circumstances because the voltage differential across the one or more rotatable elements (i.e., the voltage supplied by the first voltage source 210) may preferably be greater than the threshold voltage for rotation of the one or more rotatable elements.

In an alternate embodiment, a plurality of switching elements may be used in place of the single switching element 225 shown in FIG. 2. Each of the plurality of switching elements may be connected to a conductive layer covering a portion of the second device 235. The use of multiple conductive layers may permit a plurality of regions to be created within the second device 235. Alternatively, a plurality of second devices may each have one or more conductive layers each attached to one of the plurality of switching elements. Each conductive layer may switch independently of the other conductive layers.

In an alternate embodiment, a plurality of devices may replace the first device 230 shown in FIG. 2. Each of the plurality of devices may have its power rail connected to the positive terminal of the second voltage source 215 and its ground rail connected to the negative terminal of the second voltage source 215. The use of a plurality of devices in place of the first device 230 may allow multiple devices to be operated from the same bias offset voltage circuit.

In an alternate embodiment, the second voltage source 215 may control a switching element, such as switching element 225 in FIG. 2 instead of a first device. Similarly, the outputs of the voltage sources that are connected to the input terminals of the switching element 225 may be used to supply the power and ground rails of a device, such as the first device 230 in FIG. 2.

In an alternate embodiment, a bias offset voltage circuit may include one or more additional pairs of voltage sources. Each pair of voltage sources may include a positive voltage source and a negative voltage source. The positive voltage source may include a positive terminal and a negative terminal. The negative voltage source may include a positive terminal and a negative terminal. The first additional pair of voltage sources may have the positive terminal of the negative voltage source connected to the negative terminal of the first voltage source and the negative terminal of the positive voltage source connected to the positive terminal of the third voltage source. Each subsequent additional pair of voltage sources may be similarly connected to the preceding pair of voltage sources.

In an embodiment, each additional pair of voltage sources may have the negative terminal of the negative voltage source attached to ground rails of one or more devices and the positive terminal of the positive voltage source attached to power rails of one or more devices. In an alternate embodiment, the negative terminal of the negative voltage source may be attached to a negative input terminal of one or more switching elements and the positive terminal of the positive voltage source may be attached to a positive input terminal of the one or more switching elements. In a further embodiment, one or more devices and one or more switching elements may each be attached as stated above.

What is claimed is:

1. A bias offset voltage circuit, comprising:

a first voltage source having a first positive terminal, a first negative terminal and a first voltage differential equal to the voltage difference between the first positive terminal and the first negative terminal;

a second voltage source having a second positive terminal, a second negative terminal and a second voltage differential equal to the voltage difference between the second positive terminal and the second negative terminal;

a third voltage source having a third positive terminal and a third negative terminal and a third voltage differential equal to the voltage difference between the third positive terminal and the third negative terminal;

a switching element having a positive input terminal, a negative input terminal and an output terminal, wherein the first negative terminal is electrically connected to the negative input terminal, wherein the first positive terminal is electrically connected to the second negative terminal, wherein the second positive terminal is electrically connected to the third negative terminal, and wherein the third positive terminal is electrically connected to the positive input terminal.

2. The circuit of claim 1, further comprising:

a first device having a power plane electrically connected to the positive terminal of the second voltage source and a ground plane electrically connected to the negative terminal of the second voltage source; and a second device having a power plane electrically connected to the output of the switching element.

3. The circuit of claim 2 wherein the first device is a thin film transistor active matrix array having a plurality of thin film transistors and the second device is a rotatable element display having a plurality of rotatable elements.

4. The circuit of claim 3 wherein each of the plurality of thin film transistors corresponds to one or more of the plurality of rotatable elements.

5. The circuit of claim 3 wherein the second voltage differential is less than an optimal voltage for rotating each of the plurality of rotatable elements in the rotatable-element display.

6. The circuit of claim 5 wherein the sum of the first voltage differential and the second voltage differential is greater than or equal to the optimal voltage for rotating each of the plurality of rotatable elements in the rotatable element display.

7. The circuit of claim 5 wherein the sum of the second voltage differential and the third voltage differential is greater than or equal to the optimal voltage for rotating each of the plurality of rotatable elements in the rotatable element display.

8. The circuit of claim 2 wherein the first voltage differential is approximately equal to the third voltage differential.

9. The circuit of claim 2 wherein the first voltage differential is approximately equal to 20 volts, the second voltage differential is approximately equal to 60 volts and the third voltage differential is approximately equal to 20 volts.

10. A bias offset voltage circuit, comprising:

a first voltage source having a first positive terminal and a first negative terminal;

one or more pairs of voltage sources each having a negative voltage source having a positive terminal and a negative terminal and a positive voltage source having a positive terminal and a negative terminal; and one or more switching elements each having a positive input terminal electrically connected to a positive terminal of a positive voltage source of a pair of voltage sources, a negative input terminal electrically connected to a negative terminal of a negative voltage source of the same pair of voltage sources, and an output terminal, wherein the first positive terminal is electrically connected to the negative terminal of the positive voltage source of a first pair of voltage sources, wherein the first negative terminal is electrically connected to the positive terminal of the negative voltage source of a first pair of voltage sources, wherein the negative terminal of the positive voltage source of each subsequent pair of voltage sources is electrically connected to the positive terminal of the positive voltage source of the preceding pair of voltage sources, and wherein the positive terminal of the negative voltage source of each subsequent pair of voltage sources is electrically connected to the negative terminal of the negative voltage source of the preceding pair of voltage sources.

* * * * *